US007557074B2

(12) United States Patent
Becker et al.

(10) Patent No.: US 7,557,074 B2
(45) Date of Patent: Jul. 7, 2009

(54) CLEANING FORMULATIONS FOR DISHCLEANING MACHINE CONTAINING HYDROPHOBICALLY MODIFIED POLYCARBOXYLATE

(75) Inventors: Heike Becker, Mannheim (DE); Bernhard Neuner, Neustadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 26 days.

(21) Appl. No.: 11/574,890

(22) PCT Filed: Sep. 13, 2005

(86) PCT No.: PCT/EP2005/009819

§ 371 (c)(1),
(2), (4) Date: Mar. 8, 2007

(87) PCT Pub. No.: WO2006/029806

PCT Pub. Date: Mar. 23, 2006

(65) Prior Publication Data

US 2007/0219110 A1 Sep. 20, 2007

(30) Foreign Application Priority Data

Sep. 14, 2004 (DE) ..... 10 2004 044 411

(51) Int. Cl.
*C11D 3/37* (2006.01)

(52) U.S. Cl. ..... 510/220; 510/230; 510/247; 510/475

(58) Field of Classification Search ..... 510/220, 510/475
See application file for complete search history.

(56) References Cited

U.S. PATENT DOCUMENTS

| | | | | |
|---|---|---|---|---|
| 5,232,622 | A | 8/1993 | Jones et al. | |
| 6,165,970 | A | 12/2000 | Williams et al. | |
| 7,153,816 | B2 * | 12/2006 | Kessler et al. | 510/220 |
| 2004/0072716 | A1 * | 4/2004 | Kistenmacher et al. | 510/475 |
| 2005/0075258 | A1 * | 4/2005 | Kessler et al. | 510/221 |
| 2007/0219110 | A1 * | 9/2007 | Becker et al. | 510/392 |

FOREIGN PATENT DOCUMENTS

| | | |
|---|---|---|
| DE | WO 02064720 A1 * | 8/2002 |
| EP | 0 237 075 | 9/1987 |
| EP | 0 595 590 | 5/1994 |
| WO | 97 36990 | 10/1997 |
| WO | 02 20708 | 3/2002 |
| WO | 02 064719 | 8/2002 |
| WO | 02 064720 | 8/2002 |

* cited by examiner

*Primary Examiner*—Mark Eashoo
*Assistant Examiner*—Mohammad R Asdjodi
(74) *Attorney, Agent, or Firm*—Oblon, Spivak, McClelland, Maier & Neustadt, P.C.

(57) ABSTRACT

A phosphate-free detergent formulation for machine dishwashing comprising, as components:

a) from 1 to 20% by weight of copolymers of a1) from 20 to 80% by weight, preferably from 30 to 70% by weight, of at least one monomer from the group consisting of monoethylenically unsaturated $C_3$-$C_{10}$-mono- or -dicarboxylic acids or anhydrides thereof, a2) from 0 to 80% by weight, preferably from 10 to 50% by weight, of at least one monomer of the general formula (I), (I)

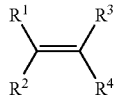

where $R^1$, $R^2$ and $R^3$ are each independently H, $CH_3$ or $C_2H_5$, $R^4$ is a linear, branched or cyclic radical having from 1 to 6 carbon atoms or an aromatic radical having from 6 to 12 carbon atoms, and a3) from 0 to 80% by weight, preferably from 5 to 20% by weight, of at least one further monomer selected from the group consisting of olefins having 10 or more carbon atoms or mixtures thereof and reactive polyisobutenes having on average from 12 to 100 carbon atoms, b) from 1 to 50% by weight of complexing agents, selected from the group consisting of nitrilotriacetic acid, hydroxyethylethylenediaminetriacetic acid, ethylenediaminetetraacetic acid, diethylenetriaminepentaacetic acid, methylglycinediacetic acid, glutaminicaciddiacetic acid, iminodisuccinic acid, hydroxyiminodisuccinic acid, ethylendiaminodisuccinic acid, asparaginicaciddiacetic acid and salts therof, c) from 1 to 15% by weight of low-foaming nonionic surfactants, d) from 0.1 to 30% by weight of bleaches and, if appropriate, bleach activators, e) from 0 to 60% by weight of further builders, f) from 0 to 8% by weight of enzymes, g) from 0 to 50% by weight of one or more further additives such as anionic or zwitterionic surfactants, bleach catalysts, alkali carriers, corrosion inhibitors, defoamers, dyes, fragrances, fillers, organic solvents and water, the sum of components a) to g) adding up to 100% by weight.

6 Claims, No Drawings

CLEANING FORMULATIONS FOR DISHCLEANING MACHINE CONTAINING HYDROPHOBICALLY MODIFIED POLYCARBOXYLATE

The invention relates to detergent formulations for machine dishwashing.

When dishes are cleaned in a machine dishwasher, during the cleaning cycle, the dishes are freed from the soil composed of a wide variety of food residues which also comprise fatty and oily constituents. The removed soil particles and components are circulated by pumping in the rinse water of the machine in the course of further cleaning. It has to be ensured that the removed soil particles are dispersed and emulsified effectively, so that they do not settle again on the ware.

Many formulations present on the market are phosphate-based. The phosphate used is ideal for the application, since it combines many useful properties which are required in machine dishwashing. One is that phosphate is capable of dispersing water hardness (i.e. insoluble salts of ions such as calcium and magnesium ions which cause water hardness). In fact, this task is also achieved by the ion exchanger of the machines. A large proportion of the products for machine dishwashing is, though, supplied nowadays in the form of what are known as 3-in-1 formulations in which the function of the ion exchanger is no longer needed. In this case, the phosphate, usually combined with phosphonates, takes over the softening of the water. In addition, the phosphate disperses the soil removed and thus prevents resettling of the soil on the ware.

In the case of cleaning compositions, many countries have made the transition for ecological reasons to fully phosphate-free systems. For the products for machine dishwashing too, there is discussion as to whether reversion to phosphate-free products is viable. However, the phosphate-free products which were still on the market in the mid-1990s no longer satisfy the current demands on the wash result. Nowadays, the consumer expects faultless, streak-, film- and drip-free dishes, preferably without the use of additional rinse aid or regenerating salt for the ion exchanger.

It is an object of the invention to provide phosphate-free detergent formulations for machine dishwashing. It is a particular object of the invention to provide such formulations which give rise to streak-, film- and drip-free dishes without use of additional rinse aid.

It has now been found that the replacement of phosphate can be achieved by the use of hydrophobically modified polycarboxylates in combination with certain complexing agents.

In this case, the complexing agents assume the task of complexing the ions which cause water hardness (calcium and magnesium ions) which are present in the rinse water or the food residues. Polycarboxylates likewise have calcium dispersion capacity and are additionally also capable of dispersing the soil present in the wash liquor. Particularly hydrophobically modified polycarboxylates have been found to be advantageous. It is assumed that the hydrophobic side chains are capable of interacting with hydrophobic soil constituents such as oils and fats.

The object is thus achieved by phosphate-free detergent formulations for machine dishwashing, comprising, as components:

a) from 1 to 20% by weight of copolymers of a1) from 20 to 80% by weight, preferably from 30 to 70% by weight, of at least one monomer from the group consisting of monoethylenically unsaturated $C_3$-$C_{10}$-mono- or -dicarboxylic acids or anhydrides thereof, a2) from 0 to 80% by weight, preferably from 10 to 50% by weight, of at least one monomer of the general formula (I)

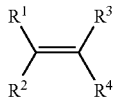

(I)

where $R^1$, $R^2$ and $R^3$ are each independently H, $CH_3$ or $C_2H_5$, $R^4$ is a linear, branched or cyclic radical having from 1 to 6 carbon atoms or an aromatic radical having from 6 to 12 carbon atoms, and a3) from 0 to 80% by weight, preferably from 5 to 20% by weight, of at least one further monomer selected from the group consisting of olefins having 10 or more carbon atoms or mixtures thereof and reactive polyisobutenes having on average from 12 to 100 carbon atoms, b) from 1 to 50% by weight, preferably from 5 to 40% by weight, of complexing agents, selected from the group consisting of nitrilotriacetic acid, ethylenediaminetetraacetic acid, diethylenetriaminepentaacetic acid, hydroxyethylethylenediaminetriacetic acid and methylglycinediacetic acid, glutaminicaciddiacetic acid, iminodisuccinic acid, hydroxyiminodisuccinic acid, ethylendiaminodisuccinic acid, asparaginicaciddiacetic acid and salts therof, c) from 1 to 15% by weight, preferably from 1 to 10% by weight, of low-foaming nonionic surfactants, d) from 0.1 to 30% by weight, preferably from 1 to 20% by weight, of bleaches and, if appropriate, bleach activators, e) from 0 to 60% by weight, preferably from 0 to 40% by weight, of further builders, f) from 0 to 8% by weight, preferably from 0 to 5% by weight, of enzymes, g) from 0 to 50% by weight, preferably from 0.1 to 50% by weight, of one or more further additives such as anionic or zwitterionic surfactants, bleach catalysts, alkali carriers, corrosion inhibitors, defoamers, dyes, fragrances, fillers, organic solvents and water, the sum of components a) to g) adding up to 100% by weight.

The formulation may be processed as a tablet, powder, gel, capsule or solution. They may either be formulations for household applications or for industrial applications.

The object is also achieved by the use of a combination of copolymers a) and complexing agents b) as builder systems in detergent formulations for machine dishwashing.

Suitable monomers a1) are, for example, maleic acid, maleic anhydride, acrylic acid, methacrylic acid, fumaric acid, itaconic acid and citraconic acid. Preferred copolymers a) contain, as monomers a1), monomers which are selected from the group consisting of maleic acid, maleic anhydride and acrylic acid.

Suitable monomers a2) are, for example, isobutene, diisobutene, butene, pentene, hexene and styrene. Further preferred copolymers a) contain, as monomers a2), monomers which are selected from the group consisting of isobutene, diisobutene (2-methyl-3,3-dimethyl-1-butene) and styrene.

Suitable monomers a3) have at least 10, generally 10-26, carbon atoms. Suitable monomers a3) are, for example, 1-decene, 1-dodecane, 1-tetradecene, 1-hexadecene, 1-octadene, 1-eicosene, 1-docosene, 1-tetracosene and 1-hexacosene. Further preferred copolymers a) contain, as monomers a3), monomers which are selected from the group consisting of 1-dodecene, 1-octadecene, $C_{22}$-alpha-olefin, a mixture of $C_{20}$-$C_{24}$-alpha-olefins and polyisobutene having on average from 12 to 100carbon atoms.

Particularly preferred copolymers a) contain monomers a1) which are selected from maleic acid, maleic anhydride and acrylic acid, and monomers a2) which are selected from isobutene, diisobutene and styrene, and monomers a3) which are selected from the group consisting of 1-dodecene, 1-octadecene, $C_{ss}$-alpha-olefin, a mixture of $C_{20}$-$C_{24}$-alpha-olefins and polyisobutene having on average from 12 to 100 carbon atoms. Special preference is given to copolymers of from 30 to 70% by weight of maleic acid and maleic anhydride as monomers al), from 20 to 40% by weight of isobutene as monomers a2) and from 5 to 20% by weight of octadecene as monomers a3).

As component b), the inventive detergent formulations comprise one or more complexing agents which are selected from the group consisting of nitrilotriacetic acid, ethylenediaminetetraacetic acid, diethylenetriaminepentaacetic acid, hydroxyethylethylenediaminetriacetic acid, methylglycinediacetic acid, glutaminicaciddiacetic acid, iminodisuccinic acid, hydroxyiminodisuccinic acid, ethylendiaminodisuccinic acid, asparaginicaciddiacetic acid and salts therof. A preferred complexing agents b) are methylglycinediacetic acid and salts therof.

As component c), the inventive detergent formulations comprise low-foaming or nonfoaming nonionic surfactants. These are generally present in proportions of from 0.1 to 20% by weight, preferably from 0.1 to 15% by weight, more preferably from 0.25 to 10% by weight.

Suitable nonionic surfactants include the surfactants of the general formula (II)

$$R^2—O—(CH_2CH_2O)_p—(CHR^1CH_2O)_m—R^3 \quad (II)$$

where $R^2$ is a linear or branched alkyl radical having from 8 to 22 carbon atoms, $R^1$ and $R^3$ are each independently hydrogen or a linear or branched alkyl radical having 1-10 carbon atoms or H, where $R^1$ is preferably methyl, p and m are each independently from 0 to 300. Preferably, p=1-50 and m=0-30.

The surfactants of the formula (II) may be either random copolymers or block copolymers, and are preferably block copolymers.

In addition, it is possible to use di- and multiblock copolymers composed of ethylene oxide and propylene oxide, which are commercially available, for example, under the name Pluronic® (BASF Aktiengesellschaft) or Tetronic® (BASF Corporation). In addition, it is possible to use reaction products of sorbitan esters with ethylene oxide and/or propylene oxide. Likewise suitable are amine oxides or alkylglycosides. An overview of suitable nonionic surfactants is given by EP-A 851 023 and by DE-A 198 19 187.

The formulations may further comprise anionic or zwitterionic surfactants, preferably in a blend with nonionic surfactants. Suitable anionic and zwitterionic surfactants are likewise specified in EP-A 851 023 and DE-A 198 19 187.

As component d), the inventive detergent formulations comprise bleaches and, if appropriate, bleach activators.

Bleaches subdivide into oxygen bleaches and chlorine bleaches. Oxygen bleaches which find use are alkali metal perborates and hydrates thereof, and also alkali metal percarbonates. Preferred bleaches in this context are sodium perborate in the form of a mono- or tetrahydrate, sodium percarbonate or the hydrates of sodium percarbonate.

Oxygen bleaches which can likewise be used are persulfates and hydrogen peroxide.

Typical oxygen bleaches are also organic peracids, for example perbenzoic acid, peroxy-alpha-naphthoic acid, peroxylauric acid, peroxystearic acid, phthalimidoperoxycaproic acid, 1,12-diperoxydodecanedioic acid, 1,9-diperoxyazelaic acid, diperoxoisophthalic acid or 2-decyldiperoxybutane-1,4-dioic acid.

In addition, the following oxygen bleaches may also find use in the detergent formulation:

Cationic peroxy acids which are described in the patent applications U.S. Pat. No. 5,422,028, U.S. Pat. No. 5,294,362 and U.S. Pat. No. 5,292,447;

sulfonylperoxy acids which are described in the patent application U.S. Pat. No. 5,039,447.

Oxygen bleaches are used in amounts of generally from 0.5 to 30% by weight, preferably of from 1 to 20% by weight, more preferably of from 3 to 15% by weight, based on the overall detergent formulation.

Chlorine bleaches and the combination of chlorine bleaches with peroxidic bleaches may likewise be used. Known chlorine bleaches are, for example, 1,3-dichloro-5,5-dimethylhydantoin, N-chlorosulfamide, chloramine T, dichloramine T, chloramine B, N,N'-dichlorobenzoylurea, N,N'-dichloro-p-toluenesulfonamide or trichloroethylamine. Preferred chlorine bleaches are sodium hypochlorite, calcium hypochlorite, potassium hypochlorite, magnesium hypochlorite, potassium dichloroisocyanurate or sodium dichloroisocyanurate.

Chlorine bleaches are used in amounts of generally from 0.1 to 20% by weight, preferably of from 0.2 to 10% by weight, more preferably of from 0.3 to 8% by weight, based on the overall detergent formulation.

In addition, small amounts of bleach stabilizers, for example phosphonates, borates, metaborates, metasilicates or magnesium salts, may be added.

Bleach activators are compounds which, under perhydrolysis conditions, give rise to aliphatic peroxocarboxylic acids having preferably from 1 to 10 carbon atoms, in particular from 2 to 4 carbon atoms, and/or substituted perbenzoic acid. Suitable compounds contain one or more N— or O-acyl groups and/or optionally substituted benzoyl groups, for example substances from the class of the anhydrides, esters, imides, acylated imidazoles or oximes. Examples are tetraacetylethylenediamine (TAED), tetraacetylmethylenediamine (TAMD), tetraacetylglycoluril (TAGU), tetraacetylhexylenediamine (TAHD), N-acylimides, for example N-nonanoylsuccinimide (NOSI), acylated phenolsulfonates, for example n-nonanoyl- or isononanoyloxybenzenesulfonates (n- and iso-NOBS), pentaacetylglucose (PAG), 1,5-diacetyl-2,2-dioxohexahydro-1,3,5-triazine (DADHT) or isatoic anhydride (ISA). Likewise suitable as bleach activators are nitrile quats, for example, N-methylmorpholiniumacetonitrile salts (MMA salts) or trimethylammoniumacetonitrile salts (TMAQ salts).

Preferentially suitable bleach activators are from the group consisting of polyacylated alkylenediamines, more preferably TAED, N-acylimides, more preferably NOSI, acylated phenolsulfonates, more preferably n- or iso-NOBS, MMA and TMAQ.

In addition, the following substances may find use as bleach activators in the detergent formulation:

carboxylic acids, for example phthalic anhydride; acylated polyhydric alcohols, for example triacetin, ethylene glycol diacetate or 2,5-diacetoxy-2,5-dihydrofuran; the enol esters known from DE-A 196 16 693 and DE-A 196 16 767, and also acylated sorbitol and mannitol and the mixtures thereof described in EP-A 525 239; acylated sugar derivatives, in particular pentaacetylglucose (PAG), pentaacetylfructose, tetraacetylxylose and octaacetyllactose, and also acylated, optionally N-alkylated, glucamine and gluconolactone, and/or N-acylated lactams, for example N-benzoylcaprolactam, which are known from the documents WO 94/27 970, WO 94/28 102, WO 94/28 103, WO 95/00 626, WO 95/14 759 and WO 95/17 498;

the hydrophilically substituted acylacetals listed in DE-A 196 16 769 and the acyllactams described in DE-A 196 16 770 and WO 95/14 075 may be used, just like the combinations, known from DE-A 44 43 177, of conventional bleach activators.

Bleach activators are used in amounts of generally from 0.1 to 10% by weight, preferably of from 1 to 9% by weight, more preferably of from 1.5 to 8% by weight, based on the overall detergent formulation.

As component e), the inventive detergent formulations may comprise further builders. It is possible to use water-soluble and water-insoluble builders, whose main task consists in binding calcium and magnesium.

The further builders used may be:

low molecular weight carboxylic acids and salts thereof, such as alkali metal citrates, in particular anhydrous trisodium citrate or trisodium citrate dihydrate, alkali metal succinates, alkali metal malonates, fatty acid sulfonates, oxydisuccinate, alkyl or alkenyl disuccinates, gluconic acids, oxadiacetates, carboxymethyloxysuccinates, tartrate monosuccinate, tartrate disuccinate, tartrate monoacetate, tartrate diacetate, α-hydroxypropionic acid;

oxidized starches, oxidized polysaccharides;

homo- and copolymeric polycarboxylic acids and salts thereof, such as polyacrylic acid, polymethacrylic acid, copolymers of maleic acid and acrylic acid;

graft polymers of monoethylenically unsaturated mono- and/or dicarboxylic acids on monosaccharides, oligosaccharides, polysaccharides or polyaspartic acid;

aminopolycarboxylates and polyaspartic acids;

phosphonates such as 2-phosphono-1,2,4-butanetricarboxylic acid, aminotri(methylenephosphonic acid), 1-hydroxyethylene(1,1-diphosphonic acid), ethylenediaminetetramethylenephosphonic acid, hexamethylenediaminetetramethylenephosphonic acid or diethylenetriaminepentamethylenephosphonic acid;

silicates such as sodium disilicate and sodium metasilicate;

water-insoluble builders such as zeolites and crystalline sheet silicates.

As component f), the inventive detergent formulations comprise enzymes. It is possible to add to the detergent between 0 and 8% by weight of enzymes based on the overall formulation in order to increase the performance of the detergent or to ensure the cleaning performance in the same quality under milder conditions. The enzymes used most frequently include lipases, amylases, cellulases and proteases. In addition, it is also possible, for example, to use esterases, pectinases, lactases and peroxidases.

The inventive detergents may additionally comprise, as component g), further additives such as anionic or zwitterionic surfactants, bleach catalysts, alkali carriers, corrosion inhibitors, defoamers, dyes, fragrances, fillers, organic solvents and water.

In addition to or instead of the above-listed conventional bleach activators it is also possible for the sulfonimines known from EP-A 446 982 and EP-A 453 003 and/or bleach-boosting transition metal salts or transition metal complexes to be present in the inventive detergent formulations as what are known as bleach catalysts.

The useful transition metal compounds include, for example, the manganese-, iron-, cobalt-, ruthenium- or molybdenum-salen complexes known from DE-A 195 29 905 and the N-analog compounds thereof known from DE-A 196 20 267, the manganese-, iron-, cobalt-, ruthenium- or molybdenum-carbonyl complexes known from DE-A 195 36 082, the manganese, iron, cobalt, ruthenium, molybdenum, titanium, vanadium and copper complexes which have nitrogen-containing tripod ligands and are described in DE-A 196 05 688, the cobalt-, iron-, copper- and ruthenium-amine complexes known from DE-A 196 20 411, the manganese, copper and cobalt complexes described in DE-A 44 16 438, the cobalt complexes described in EP-A 272 030, the manganese complexes known from EP-A 693 550, the manganese, iron, cobalt and copper complexes known from EP-A 392 592, and/or the manganese complexes described in EP-A 443 651, EP-A 458 397, EP-A 458 398, EP-A 549 271, EP-A 549 272, EP-A 544 490 and EP-A 544 519. Combinations of bleach activators and transition metal bleach catalysts are known, for example, from DE-A 196 13 103 and WO 95/27 775.

Dinuclear manganese complexes which contain 1,4,7-trimethyl-1,4,7-triazacyclononane (TMTACN), for example $[(TMTACN)_2Mn^{IV}Mn^{IV}(\mu\text{-}O)_3]^{2+}(PF_6^-)_2$ are likewise suitable as effective bleach catalysts. These manganese complexes are likewise described in the aforementioned documents.

Suitable bleach catalysts are preferably bleach-boosting transition metal complexes or salts from the group consisting of the manganese salts and complexes and the cobalt salts and complexes. More preferably suitable are the cobalt(amine) complexes, the cobalt(acetate) complexes, the cobalt(carbonyl) complexes, the chlorides of cobalt or manganese, manganese sulfate or $[(TMTACN)_2Mn^{IV}Mn^{IV}(\mu\text{-}O)_3]^{2+}(PF_6^-)_2$.

Bleach catalysts may be used in amounts of from 0.0001 to 5% by weight, preferably of from 0.0025 to 1% by weight, more preferably of from 0.01 to 0.25% by weight, based on the overall detergent formulation.

As further constituents of the detergent formulation, alkali carriers may be present. Alkali carriers are ammonium and/or alkali metal hydroxides, ammonium and/or alkali metal carbonates, ammonium and/or alkali metal hydrogencarbonates, ammonium and/or alkali metal sesquicarbonates, ammonium and/or alkali metal silicates, ammonium and/or alkali metal metasilicates and mixtures of the aforementioned substances, preference being given to using ammonium and/or alkali metal carbonates, in particular sodium carbonate, sodium hydrogencarbonate or sodium sesquicarbonate.

The corrosion inhibitors used may be silver protectants from the group of the triazoles, the benzotriazoles, the bisbenzotriazoles, the aminotriazoles, the alkylaminotriazoles and the transition metal salts or complexes. Particular preference is given to using benzotriazole and/or alkylaminotriazole. In addition, active chlorine-containing agents which distinctly reduce the corrosion of the silver surface frequently find use in detergent formulations. In chlorine-free detergents, preference is given to using oxygen- and nitrogen-containing organic redox-active compounds such as di- and trihydric phenols, for example hydroquinone, pyrocatechol, hydroxyhydroquinone, gallic acid, phloroglucine, pyrogallol and derivatives of these compound classes. Salt- and complex-type inorganic compounds such as salts of the metals Mn, Ti, Zr, Hf, V, Co and Ce frequently also find use. Preference is given in this context to the transition metal salts which are selected from the group of the manganese and/or cobalt salts and/or complexes, more preferably from the group of the cobalt(amine) complexes, the cobalt(acetate) complexes, the cobalt(carbonyl) complexes, the chlorides of cobalt or manganese, and of magnesium sulfate. It is likewise possible to use zinc compounds or bismuth compounds to prevent corrosion on the ware.

Paraffin oils and silicone oils may optionally be used as defoamers and to protect plastics and metal surfaces. Defoamers are used generally in proportions of from 0.001% by weight to 5% by weight. In addition, dyes, for example patent blue, preservatives, for example Kathon CG, perfumes and other fragrances may be added to the inventive detergent formulation.

An example of a suitable filler is sodium sulfate.

The invention is illustrated in detail by the examples which follow.

EXAMPLES

Examples 1 to 6 and Comparative Examples C1 to C4

To test the inventive copolymers, each of them was added to a simplified phosphate-free dishwasher detergent formulation which was based on MGDA (methylglycine diacetate) as a granule and sodium carbonate, and had the composition below.

Simplified dishwasher detergent formulation:

33% by weight of MGDA (granule)

48% by weight of sodium carbonate

16% by weight of low-foaming nonionic surfactant based on fatty alcohol alkoxylates 3% by weight of hydroxyethane-1,1-diphosphonic acid In the wash experiments described below, in each case 6.5 g of the detergent formulation and 2.1 g of polymer were used (33% by weight based on the formulation). In each case 50 g of IKW ballast soil, corresponding to SÖFW Journal, 124, 14/98, p. 1029, was introduced into the washing machine at the start of the experiment. The testing was under the washing conditions below.

Washing Conditions:

Dishwasher: Miele G 686 SC

Wash cycles: 2 wash cycles, 55° C., normal (without prewash)

Ware: knives (WMF Berlin table knives, monobloc) and glass tumblers (Matador, Ruhr Kristall), plastic plates: Kayser SAN plates ballast dishes: 6 black dessert plates Dishwasher detergent: 6.5 g Copolymer: 2.1 g (active)

Soil addition 50 g of IKW ballast soil at the start

Rinse temperature: 65° C.

Water hardness: 14° GH (corresponding to 250 mg $CaCO_3$/kg, examples 1-4 and C1, C2) or 25° GH (corresponding to 445 mg $CaCO_3$/kg, examples 5, 6, C3 and C4)

The ware was evaluated 18 h after the cleaning by visual grading in a light box which has a black coating and a halogen spotlight and perforated plate, using a scale of from 10 (very good) to 1 (very poor). The highest mark of 10 corresponds to film- and drip-free surfaces; from marks <5, films and drops are discernible even under normal room lighting, and are thus regarded as objectionable.

The following polymers were used:

Polymer 1: copolymer of maleic acid and diisobutene (weight ratio 51:49) with a molecular weight of 12 000 g/mol.

Polymer 2: copolymer of maleic anhydride, isobutene and C18-olefin (weight ratio 65:26:9), molecular weight 3000 g/mol.

Polymer 3: copolymer of maleic anhydride, C22-α-olefin, (weight ratio 25.5:74.5), molecular weight 12 000 g/mol.

Polymer 4: copolymer of maleic acid and isobutene (weight ratio 68:32) with a molecular weight of 4000 g/mol.

Polymer 5: polyacrylic acid, molecular weight 8000 g/mol.

The results of the wash experiments are compiled in the tables 1 and 2 below.

TABLE 1

Results in a wash test at a water hardness of 14° GH

| Example | | Film on knives | Film on glasses | Film and spotting on plastic (average) |
|---|---|---|---|---|
| C1 | Without polymer | 4 | 3 | 3.3 |
| 1 | Polymer 1 | 6.7 | 7 | 4.2 |
| 2 | Polymer 2 | 7.5 | 7.5 | 4.2 |
| 3 | Polymer 3 | 4 | 5.2 | 5.8 |
| 4 | Polymer 4 | 5.2 | 5.7 | 3.3 |
| C2 | Polymer 5 | 6.2 | 5 | 3.3 |

TABLE 2

Results in a wash test at a water hardness of 25° GH

| Example | | Film on knives | Film on glasses | Film and spotting on plastic (average) |
|---|---|---|---|---|
| C3 | Without polymer | 3.0 | 3 | 3.3 |
| 5 | Polymer 1 | 7.0 | 7.2 | 5.8 |
| 6 | Polymer 2 | 7.7 | 7.2 | 5.8 |
| C4 | Polymer 5 | 3.5 | 2.7 | 4.2 |

The results show that the addition of the copolymers in the MGDA-containing dishwasher formulation affords a distinct improvement in the wash result. At 14° GH, it is also possible to achieve effects with simple polycarboxylates; at higher water hardness, a distinct advantage of the hydrophobically modified polycarboxylates becomes apparent.

What is claimed is:

1. A phosphate-free detergent formulation for machine dishwashing comprising, as components:

a) from 1 to 20% by weight of copolymers of a1) from 30 to 70% by weight of maleic acid or maleic acid anhydride, a2) from 20 to 40% by weight of isobutene, and a3) from 5 to 20% by weight of octadecene, b) from 1 to 50% by weight of a complexing agent selected from the group consisting of nitrilotriacetic acid, hydroxyethylethylenediaminetriacetic acid, ethylenediaminetetraacetic acid, diethylenetriaminepentaacetic acid, methylglycinediacetic acid, glutaminicaciddiacetic acid, iminodisuccinic acid, hydroxyiminodisuccinic acid, ethyleneiminodisuccinic acid, asparaginicaciddiacetic acid and salts thereof, c) from 1 to 15% by weight of low-foaming nonionic surfactants, d) from 0.1 to 39% by weight of bleaches and, optionally, bleach activators, e) from 0 to 60% by weight of builders, f) from 0 to 8% by weight of enzymes, g) from 0 to 50% by weight of one or more additional additives selected from the group consisting of anionic or zwitterionic surfactants, bleach catalysts, alkali carriers, corrosion inhibitors, defoamers, dyes, fragrances, fillers, organic solvents and water, the sum of components a) to g) adding up to 100% by weight.

2. The phosphate-free detergent formulation according to claim 1, wherein said complexing agent b) is methyiglycinediacetic acid and/or salts thereof.

3. The phosphate-free detergent formulation according to claim 1, wherein said low-foaming nonionic surfactant has the formula:

$$R^2—O—(CH_2CH_2O)_p—(CHR^1CH^2O)_m—R^3$$

and wherein $R^2$ is a linear or branched alkyl radical having from 8 to 22 carbon atoms, $R^1$ and $R^3$ are each independently hydrogen or linear or branched alkyl radical having from 1-10 carbon atoms or H.

4. The phosphate-free detergent formulation according to claim 1, wherein said bleach is a chlorine or oxygen bleach.

5. A builder system for a phosphate-free detergent formulation for machine dishwashing consisting of a) a copolymer prepared from the monomers:

a1) from 30 to 70% by weight of maleic acid or maleic acid anhydride, a2) from 20 to 40% by weight of isobutene, and a3) from 5 to 20% by weight of octadecene, b) a complexing agent selected from the group consisting of nitrilotriacetic acid, hydroxyethylethylenediaminetriacetic acid, ethylenediaminetetraacetic acid, diethylenetriaminepentaacetic acid, methylglycinediacetic acid, glutaminicaciddiacetic acid, iminodisuccinic acid, hydroxyiminodisuccinic acid, ethyleneiminodisuccinic acid, asparaginicaciddiacetic acid and salts thereof.

6. The builder system according to claim 5, wherein said complexing agent b) is methylglycinediacetic acid and/or salts thereof.

* * * * *